United States Patent [19]

Weinert et al.

[11] 4,177,000

[45] Dec. 4, 1979

[54] ROTATABLE LOAD CLAMP ADAPTED FOR SELECTIVE LOAD POSITIONING IN RESPONSE TO SELECTIVE ROTATIONAL POSITIONING OF CLAMP

[75] Inventors: Harry F. Weinert, Portland; Larry D. McCart, Lake Oswego; David J. Weisgerber, Gresham, all of Oreg.

[73] Assignee: Cascade Corporation, Portland, Oreg.

[21] Appl. No.: 888,925

[22] Filed: Mar. 22, 1978

[51] Int. Cl.[2] ..... B66C 1/42

[52] U.S. Cl. ..... 414/620; 91/512; 414/911

[58] Field of Search ..... 214/650 R, 650 SG, 651, 214/652, 653, 654, 655, 147 G, 147 R, 1 BD, 1 BC, 1 BV, 1 BH, 147 T, DIG. 4; 91/512; 414/618, 619, 620, 621, 622, 623, 730, 732, 911

[56] References Cited

U.S. PATENT DOCUMENTS

| | | | |
|---|---|---|---|
| 2,754,018 | 7/1956 | Schroeder | 214/652 |
| 3,179,274 | 4/1965 | Comfort | 214/652 |
| 3,395,732 | 8/1968 | Comfort | 214/652 X |
| 3,623,620 | 11/1971 | Vermette | 214/652 X |
| 3,896,957 | 7/1975 | Sinclair | 214/652 |

FOREIGN PATENT DOCUMENTS

| | | | |
|---|---|---|---|
| 537947 | 2/1977 | U.S.S.R. | 214/652 |

OTHER PUBLICATIONS

"Operators and Owners Guide–Paper Roll Clamps", Published by Cascade Corporation of Portland, Oregon–p. 6.

"Slide #1.08" from Service Training–Pivot Arm Paper Roll Clamps, Published by Cascade Corporation of Portland, Oregon.

*Primary Examiner*—Frank E. Werner

*Attorney, Agent, or Firm*—Chernoff & Vilhauer

[57] ABSTRACT

A selectively rotatable load clamp for lift trucks, having a pair of openable and closable clamp arms. The clamp arms are capable of shifting the position of a load relative to the lift truck by movement of the clamp arms in unison, by which the load may be moved relative to the lift truck between a position of equal extension, wherein the forward ends of the clamp arms extend a substantially equal distance forwardly of the lift truck, and a position of unequal extension wherein the forward end of one clamp arm extends a greater distance forwardly than the forward end of the other clamp arm. The fluid motor apparatus for accomplishing such shifting function is selectively actuatable only in certain predetermined rotation positions of the clamp, that is, those positions where the two clamp arms are disposed at substantially a 45° angle relative to horizontal. A valve assembly responsive to the rotational position of the clamp permits the selective actuation of the shifting function in such position, while preventing the selective opening or closing of the clamp arms. Conversely, when the clamp arms are placed either one above the other or side-by-side, the selective opening or closing of the arms is permitted while the actuation of the shifting function is prevented.

3 Claims, 3 Drawing Figures

ROTATABLE LOAD CLAMP ADAPTED FOR SELECTIVE LOAD POSITIONING IN RESPONSE TO SELECTIVE ROTATIONAL POSITIONING OF CLAMP

BACKGROUND OF THE INVENTION

The present invention relates to improvements in lift truck mounted rotatable clamping apparatus for picking up, transporting and stacking loads, particularly large rolls of paper such as newsprint and kraft paper. More particularly the invention relates to improvements in lift truck clamps capable of performing the three functions of clamping a load, rotating it about an axis longitudinal of the lift truck, and shifting the position of the load generally perpendicular to such axis.

In the past, it has been recognized that it is advantageous for a lift truck-mounted rotatable paper roll clamp to be constructed such that the clamp arms are capable not only of opening and closing (the clamping function) but also of selectively shifting in unison so as to move the load with respect to the lift truck in a direction generally perpendicularly with respect to the axis of rotation of the clamp (the shifting function). The shifting function permits the clamp to be constructed such that the clamp arms are capable of engaging a load, particularly a paper roll, either in a position of equal extension, wherein the forward ends of the clamp arms on either side of the paper roll extend a substantially equal distance forwardly of the lift truck or, alternatively, in a position of unequal extension wherein the forward end of one clamp arm extends a greater distance forwardly of the lift truck than the forward end of the other. The basic desirability of achieving positions of equal and unequal arm extension respectively is that when a paper roll is lying in a horizontal position on the floor or ground, the upper clamp arm must overreach the lower clamp arm in order to grasp the roll to pick it up. Thereafter, if the paper roll is to be stacked vertically by rotating the clamp about its axis of rotation, the overreaching which is characteristic of the position of unequal extension can become an obstacle since both clamp arms should extend the same distance from the truck to place the vertical paper roll in close, compact proximity to other vertical paper rolls. The "unequal extension" position also makes it difficult to remove a vertical paper roll from a compact stack of vertical rolls because of the need to insert the clamp arms between the adjacent rolls. Accordingly, when handling rolls in the vertical position, the position of equal extension of the clamp arms is advantageous.

The above-described shifting function has been provided by certain rotatable clamps in the past, including those shown in Sinclair U.S. Pat. No. 3,896,957, Burton U.S. Pat. No. 3,583,586 and Neale, Sr. U.S. Pat. No. 2,814,396. All of these clamps utilize a pivoted arm construction providing the shifting function and permitting both the unequal extension and equal extension positions. However it should be understood, for purposes of the present invention, that such shifting function and the selective positions of unequal extension and equal extension could also be obtained by structures other than pivoted arm clamps, for example by a sliding arm clamp specially adapted to provide such function.

It should be mentioned that certain types of rotatable sliding arm clamps have been provided in the past, such as that shown in Faust et al U.S. Pat. No. 3,407,951, wherein the position of each clamp arm is controlled by a respective fluid motor independently of the other arm. In some of these previous clamps, the actuation of each arm has been accomplished through a single operator controller interconnected with the two separate fluid motors of the arms through a rotation-responsive valve which determines which fluid motor will be controlled by the single controller, depending upon the rotational position of the clamp. However such clamps cannot perform the above-described shifting function because neither fluid motor is capable of moving the clamp arms in unison, thereby making it impossible to hold the load and shift it in a direction perpendicular to the axis of rotation of the clamp. Since no such shifting of a load during transition between horizontal and vertical load positions can be accomplished with such clamps, equal and unequal arm extension positions cannot be utilized and therefore are not provided.

While the aforementioned pivoted arm rotatable clamps do provide the shifting function for obtaining the alternative positions of unequal extension and equal extension, together with the clamping and rotation functions, they have required special fluid control valve assemblies on the lift truck having three separate operator controllers for the three different functions. However the great majority of existing lift trucks equipped for operating load handling attachments are provided with no more than two separate operator controllers for the load handling attachment. Accordingly the conversion of these existing lift trucks to a rotatable clamp having the above-described shifting function presently involves not only the attachment of the clamp but also the modification of the lift truck's fluid controls, necessitating substantial additional cost for valves, labor to perform the modifications and down time for the lift truck while modifications are being made. Despite the improved operation and productivity obtainable with these clamps having the shifting function, such additional cost, labor and down time can impede their widescale adoption by lift truck users.

SUMMARY OF THE PRESENT INVENTION

The present invention is directed to improvements in rotatable clamps of the type described, having the rotation, clamping and shifting functions, which permit the use of such clamps with a lift truck having only the usual dual operator controllers provided for load-handling attachments. This result is accomplished by utilization of the premise that the major purpose of the shifting function, i.e. providing the alternative positions of unequal and equal extension respectively, can be accomplished in conjunction with the clamping function without necessarily requiring that the fluid motor used for the shifting function and the fluid motor used for the clamping function be capable of actuation simultaneously and further by recognition of the fact that actuation of the clamping (including unclamping) function is appropriate only for certain rotational positions of the clamp while actuation of the shifting function is appropriate for other rotational positions.

More specifically, a rotatable clamp will normally be called upon to clamp or unclamp a load, such as a roll of paper, substantially only in two rotational positions, i.e. when the clamp arms are positioned substantially one above the other, as in picking up or depositing a horizontal roll, or when the clamp arms are horizontally side-by-side, as in picking up or depositing a vertical roll. Intermediate these two basic rotational positions it would normally not be appropriate to actuate the clamping function by opening or closing the clamp arms.

On the other hand, considering that the unequal extension position is appropriate for handling horizontal rolls while the equal extension position is appropriate for handling vertical rolls, it is appropriate to actuate the shifting function during the transition from one of these two basic rotational positions to the other. During such transition, the clamp passes through an intermediate rotational position, i.e. where the clamp arms are disposed at substantially a 45° angle relative to horizontal. Two such intermediate positions are possible, and it is appropriate and convenient at either one of these positions to actuate the shifting function while the clamp is holding the load.

Accordingly, utilizing these principles, the present invention provides a rotation-responsive fluid valve interposed between one of the operator fluid controllers and the respective fluid motors which actuate the clamping and shifting functions respectively, such rotation-responsive valve connecting the single operator controller operatively to the clamping function fluid motor when the clamp is in one of the two aforementioned basic clamping positions while isolating the shifting function fluid motor, and conversely connecting the single controller operatively to the shifting function motor while isolating the clamping function motor when the clamp is in one of the aforementioned intermediate positions. Accordingly, the operator selectively actuates the clamping function or the shifting function with the single controller, depending upon the rotational position of the clamp which the operator in turn controls with the second fluid controller normally provided for load handling attachment operation.

Because an arrangement of this type inherently introduces the possibility that leakage through the rotation-responsive valve during actuation of the shifting function might cause an inadvertent small flow of pressurized fluid into the isolated clamping motor circuitry, tending to loosen the clamp arms' grip on the load, a special leakage bypass circuit is incorporated into the rotation-responsive valve so as to eliminate any chance of such occurrence.

Accordingly, it is a principal objective of the invention to provide an improved rotatable load clamp of the type described, having the capability of shifting the load perpendicularly to the axis of rotation of the clamp between respective positions of unequal arm extension and equal arm extension, which permits such shifting function to be actuated at rotational positions of the clamp which are intermediate the horizontal and vertical load positions, while simultaneously preventing actuation of the clamping function, so as to permit a load to be shifting between the unequal and equal arm extension positions respectively during the transitional movement of the load between horizontal and vertical positions.

It is a further objective of the present invention to provide an improved rotatable load clamp of the type described having the capability of shifting the load perpendicularly to the axis of rotation of the clamp between respective positions of unequal arm extension and equal arm extension while requiring only two separate operator fluid controllers to control all functions of the clamp.

It is a further objective of the present invention to provide means ensuring against any inadvertent relief of clamping pressure during actuation of the shifting function.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
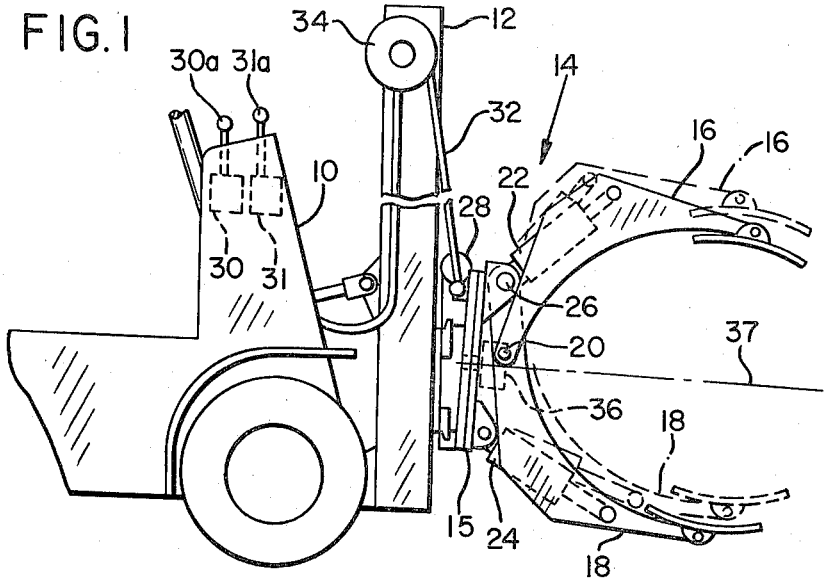
FIG. 1 is a partial side view of a lift truck having an exemplary rotatable load clamp on the front thereof constructed so as to perform the shifting function of moving the load between positions of equal and unequal extension respectively.

A typical exemplary application of the present invention is shown in FIG. 1 wherein a lift truck having a main body 10 has a load lifting mast 12 mounted at the forward end thereof with a load handling clamp attachment 14 movably mounted on the mast 12 so as to reciprocate selectively upwardly or downwardly with respect to the main body 10. The load clamp 14 may be of any of a number of different types, that shown in FIG. 1 being a paper roll handling clamp having a pair of clamp arms 16 and 18 which open and close relative to one another about a pivot axis 20 in response to the selective retraction and extension in unison of a pair of tandem, side-by-side, double acting piston and cylinder assemblies such as 22. For convenience the tandem piston and cylinder assemblies 22 will be referred to hereafter collectively as motor 22 since they act together as a single motor to perform the clamping function. Also included in the illustrative load handling clamp 14 is a double acting piston and cylinder assembly 24 (hereafter motor 24), controllable separately from the motor 22, which selectively shifts the clamp arms in unison laterally back and forth about a pivot 26 so as to thereby shift the position of the load in a direction generally perpendicular to the forwardly extending axis of rotation 37 of the clamp 14. In FIG. 1, the clamp arms are shown in solid lines in the position of unequal extension wherein the forward end of clamp arm 16 extends forwardly of the rotatable frame 15 a greater distance than the forward end of clamp 18. Upon the further extension of motor 24, arms 16 and 18 while retracting arm 16 somewhat until a position of equal extension, shown in phantom, is reached wherein the forward ends of the two clamp arms extend a substantially equal distance forwardly of the frame 15 upon which the clamp arms are mounted. This shifting can be accomplished while the clamp arms are holding a load, since the distance separating the forward ends of the two clamp arms need not change during the shifting process because such distance is controlled by the extensible position of motor 22 which also rotates about pivot 26 in unison with the clamp arms 16 and 18 during the shifting function.

A bi-directional hydraulic motor 28, controllable separately from the motors 22 and 24, is provided for selectively rotating the rotatable frame 15 and thus the clamp arms 16 and 18 about the clamp axis of rotation 37.

Because the entire load handling clamp 14, including the various fluid motors 22, 24 and 28, reciprocates vertically with respect to the main body 10 of the lift truck, and because the source of pressurized fluid, controllers 30a and 31a and their associated valves 30 and 31 controlling the various fluid motors are located on the main body 10, extensible and retractable fluid lines such as 32 must extend between the main body 10 and the clamp 14. Extension and retraction of the lines 32 is accomplished by means of a pair of rotatable hose reels such as 34, mounted upon the main body 10 or on the mast 12, capable of storing coiled lengths of fluid line and permitting the lines to be pulled from and retracted into the reels 34 in response to the vertical reciprocation of the load handling attachment 14.

It should be understood that the mechanical structure of the load handling clamp 14 depicted in FIG. 1, which is adapted primarily for handling paper rolls, is presented merely as an example of a load clamp capable of performing the shifting function of moving the load generally perpendicularly to the axis of rotation 37 between positions of equal and unequal extension of the clamp arms respectively. No claim of invention is made herein to the specific mechanical structure shown in FIG. 1, such structure having been the invention of others.

Figure 2:
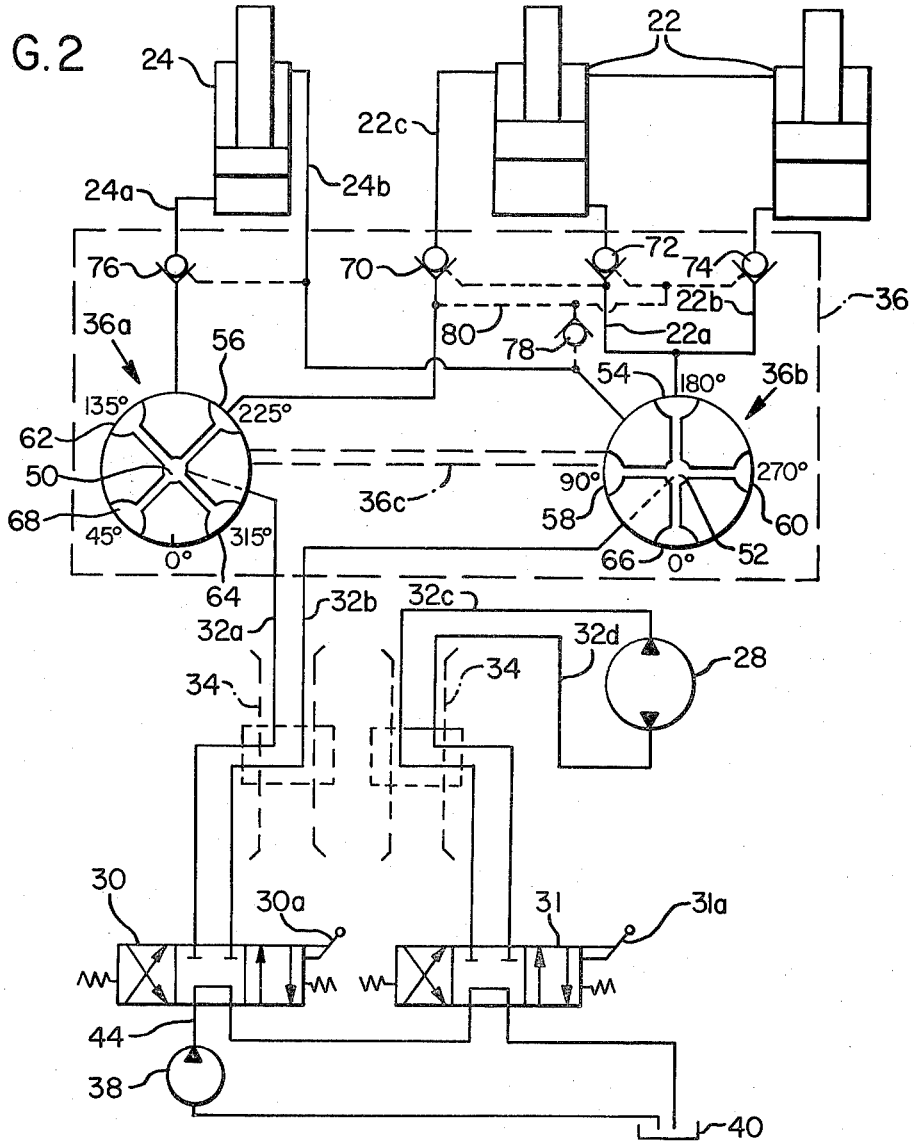
FIG. 2 is a schematic drawing of an exemplary fluid power system constructed in accordance with the present invention for controlling a load clamp of the type exemplified by FIG. 1.

FIG. 2 is a detailed schematic diagram of an exemplary fluid power system utilizing the features of the present invention in connection with the exemplary clamp 14 of FIG. 1. A source of pressurized fluid such as a pump 38 is provided, conventionally mounted on the main body 10 of the lift truck or other vehicle and driven by the engine thereof, drawing its fluid from a standard reservoir such as 40. A pair of fluid valves 30 and 31, each actuated by a manually actuated operator controller **30*a* and 31*a* respectively, are connected to the source pump 38 through a line 44. Both valves 30 and 31 operate similarly, each receiving pressurized fluid from line 44 and exhausting to the reservoir 40, and each supplying fluid to and exhausting fluid from a pair of output lines such as 32*a* and 32*b* for valve 30 and 32*c* and 32*d* for valve 31. It will be understood that in either of the two operative positions for each valve 30 or 31, one of the output lines conducts pressurized fluid to the motor being activated while the other output line simultaneously exhausts fluid from that motor, the function of each output line being reversible depending upon the position of the respective valve 30 or 31**.

The fluid controller **31*a*, acting through valve 31 and output lines 32*c* and 32*d*, operates only the bidirectional hydraulic motor 28 to rotate the clamp frame 15 selectively about the axis of rotation 37. In the centered position of the valve 31, the motor 28 and frame 15 are prevented from rotational movement. By manipulation of the controller 31a and the valve 31, the clamp may be rotated 360° about the axis of rotation 37** and stopped at any rotational position desired.

The other fluid controller **30*a*, acting through valve 30, controls the flow of fluid through output lines 32*a* and 32*b* which are operatively connected to a rotation-responsive valve assembly 36. As shwon in FIG. 2, the valve assembly 36 has two rotation-responsive valve portions 36*a* and 36*b* respectively, both being mechanically intercoupled as schematically indicated by mechanical coupling 36*c* so that rotation of the rotatable frame 15 through any particular angle produces like relative rotation through the same angle with respect to valve portions 36*a* and 36*b***.

Output line **32*a* of valve 30 is schematically shown as communicating with a central fluid chamber 50 of valve portion 36*a*. Likewise, output line 32*b* communicates with a central fluid chamber 52 of the other valve portion 36*b*. While for purposes of illustration in FIGS. 2 and 3 the central valve members housing the central chambers 50 and 52 respectively are shown as rotating in response to the rotation of the clamp, in actuality these central members would more normally be fixed, with the remainder of the valve assembly 36 being mounted on the rotating frame 15 and rotating about the central members in response to rotation of the frame 15. It will be noted that under all conditions the central valve members containing the chambers 50 and 52** respectively are oriented approximately 45° apart from one another.

In FIG. 2 the condition of the fluid circuitry in the rotational position wherein one clamp arm is located substantially above the other (as in FIG. 1) is depicted. In this rotational position, selective opening or closing of the clamp arms by actuation of fluid motor 22 is desired, while shifting of the clamp arms and thus the load by means of motor 24 is not desired. To close the clamp arms in this position, the schematic spool of valve 30 is moved to the right as shown in the figures by operator controller **30*a*, thereby interconnecting pump conduit 44 with line 32*b* and connecting line 32*a* to the reservoir 40. The pressurized fluid thus introduced into line 32*b* flows through central chamber 52 and port 54 of valve portion 36*b* which, because of the rotational position of the clamp, is aligned with the fluid lines 22*a* and 22*b* of motor 22. Simultaneously, the fluid line 22*c* is aligned with port 56 of the valve portion 36*a* which communicates with reservoir-connected line 32*a*. A pilot-operated check valve 70 interposed in line 22*c* senses an increase in pressure in lines 22*a* and 22*b* and, upon such pressure reaching a predetermined minimum level, is unseated thereby permitting fluid to exhaust from the rod ends of motor 22 through line 22*c* as fluid under pressure simultaneously is admitted through lines 22*a* and 22*b* to extend the motor 22 and close the clamp arms. Conversely, if it is desired to open the clamp arms in this rotational position, the spool of valve 30 is moved to the left by operator controller 30*a* in which case pressurized fluid from pump 38 is admitted through lines 32*a* and 22*c* to the rod ends of motor 22. Pilot-operated check valves 72 and 74 in lines 22*a* and 22*b* respectively sense the increase in pressure in line 22*c* and, when such pressure reaches a predetermined minimum level, open thereby permitting fluid to be exhausted through lines 22*a* and 22*b* as fluid enters through line 22*c*. This causes retraction of the motor 22 and results in opening of the clamp arms. Rotation of the clamp through 180° from the foregoing rotational position aligns port 66 of valve portion 36*b* with lines 22*a* and 22*b* and port 68 of valve portion 36*a* with line 22*c***, producing the same selective operational capability just described but with the positions of the clamp arms reversed.

The other basic rotational positions where selective opening and closing of the clamp arms is desired are the positions where the clamp arms are substantially side-by-side horizontally. Since these positions are 90° removed (in either direction) from that shown in FIG. 2, either port 58 or 60 of valve portion **36*b*** would be aligned with lines 22*a* and 22*b* while either port 62 or 64 respectively of valve portion 36*a* would be aligned with line 22*c*, depending upon the direction of rotation. In either case the opening and closing operations can be performed selectively by manipulation of valve 30 through the operator controller 30*a* exactly as previously described.

It will be noted that in any of the rotational positions wherein the clamp arms are one above the other or side-by-side, the various ports 54–68 of the valve portions 36*a* and 36*b* respectively are larger in area than the mating line connections, so that some variation to either side of the ideal position can be tolerated without preventing the described selective operational capability.

Figure 3:
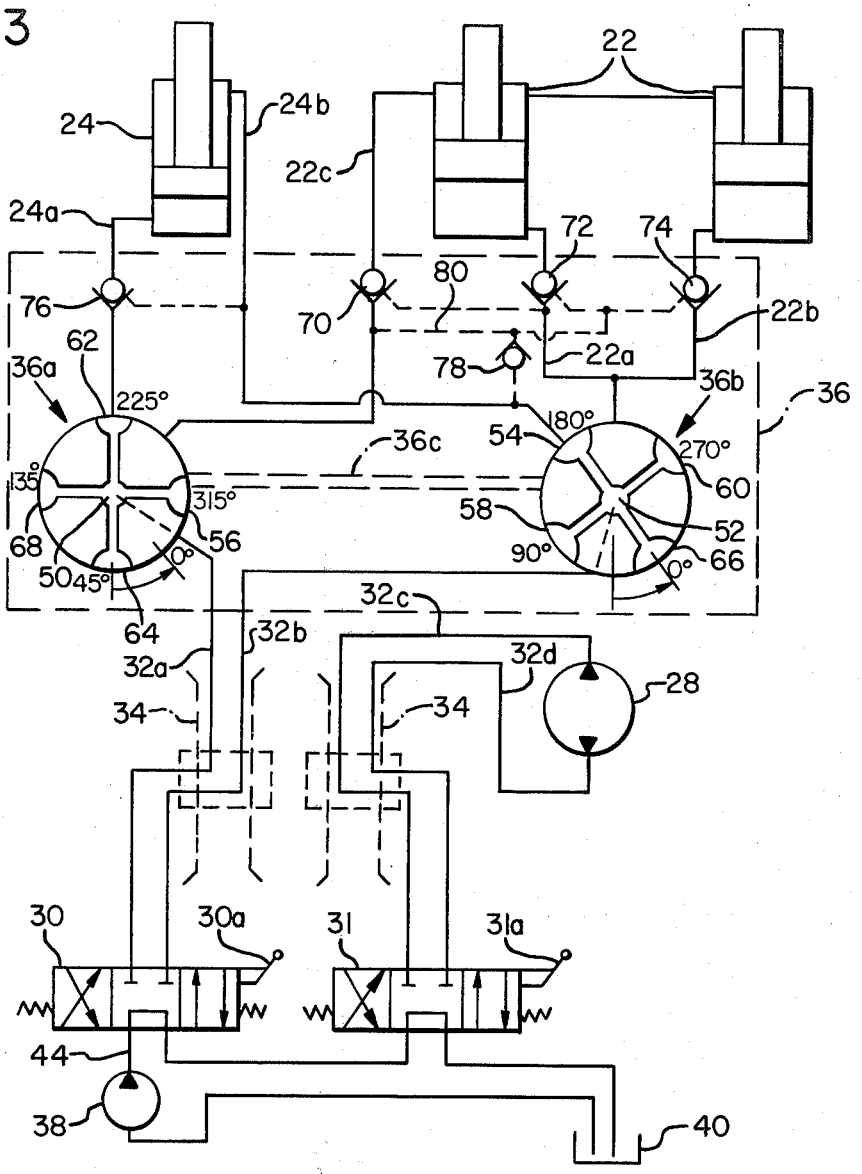
FIG. 3 is a schematic drawing of the fluid power system of FIG. 2 demonstrating operation thereof in a rotational clamp position different from that of FIG. 2.

FIG. 3 illustrates an intermediate rotational position of the clamp wherein the opposing clamp arms are at approximately a 45° angle with respect to the horizontal and thus are between the clamp arm positions just discussed. In these intermediate, or transitional, rotational positions of the clamp, it is desirable to be able to shift a clamped load perpendicular to the axis of rotation 37 so as to adjust the load from a position of equal extension of the clamp arms to one of unequal extension, or vice versa. Conversely, since the load is not in a position to be deposited in these intermediate rotational positions, it is highly undesirable for there to be any release of the clamping pressure. Accordingly, in such intermediate rotational position, it is seen that lines 22*a*, 22*b* and 22*c* of motor 22 are no longer aligned with any ports of the valve portions 36*a* and 36*b* respectively. Rather lines 24*a* and 24*b* of shifting motor 24 are aligned with port 62 of valve portion 36*a* and port 54 of valve portion 36*b* respectively. Thus the same operator control valve 30, which previously selectively controlled clamping motor 22, now instead controls shifting motor 24. Thus when the spool of valve 30 is moved to the right by operator controller 30*a*, pressurized fluid is introduced through line 32*b*, port 54 and line 24*b* to the rod end of motor 24, tending to retract the motor 24 and shift the load away from a position of equal extension of the clamp arms toward one of unequal extension. Pilot-operated check valve 76, interposed in line 24*a*, senses the increase in pressure in line 24*b* and, when such pressure reaches a predetermined minimum, opens to permit the exhaust of fluid from motor 24 through line 24*a*, port 62 and line 32*a*. Conversely, movement of the spool of valve 30 to the left in FIG. 3 produces the extension of motor 24, thereby moving the load perpendicular to the axis of rotation 37 from a position of unequal arm extension toward one of equal arm extension. In the three other intermediate positions of the clamp which are possible, it will be appreciated that the same selective operation of the shifting motor 24 through valve 30 is possible while selective operation of the clamping motor 22 is simultaneously prevented.

Special means have been provided to ensure that inadvertent retraction of the clamping motor 22, which would otherwise cause a release of clamping pressure, is prevented during selective operation of the shifting motor 24. There might be a danger, for example, of leakage developing through the rotatable valve portion 36*a* between line 24*a* of the shifting motor 24 and line 22*c* of the clamping motor 22. If such leakage were to develop due to wear or other causes, it might be possible, when line 24*a* is pressurized to extend motor 24, that line 22*c* could also become pressurized due to the leakage. This might in turn result in the opening of pilot-operated valves 72 and 74 should the inadvertent pressure in line 22*c* reach the predetermined minimum level necessary to open such valves, thereby possibly permitting some relief of clamping pressure in lines 22*a* and 22*b* through, for example, a similar leakage in valve portion 36*b*. Accordingly, to prevent any increase of pressure in line 22*c* sufficient to open pilot-operated check valves 72 and 74 during operation of shifting motor 24, a bypass check valve 78 communicating between a port of valve portion 36*b* and line 22*c* (through the pilot line 80 of valves 72 and 74) is provided. Any pressurized fluid leaking into line 22*c* through valve portion 36*a* tending to open the clamp arms by exerting opening pressure on valves 72 and 74 is thus relieved during the extension of shifting motor 24. Conversely, during the retraction of shifting motor 24*b*, pressurized fluid introduced into line 24*b* from valve portion 36*b* is prevented by the one-way action of check valve 78 from causing a pressure increase in line 22*c* or pilot line 80 sufficient to open valves 72 and 74. The bypass, or pressure relief, capability of check valve 78 is, of course, permitted only when the clamp is in an intermediate (substantially 45°) rotational position since valve portion 36*b* blocks the exhaust of fluid from line 22*c* through bypass valve 78 in the other rotational positions as shown in FIG. 2.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A load-handling clamp adapted to be mounted upon the lifting apparatus at the forward end of a lift truck for engaging a load, comprising:

(a) a frame adapted to be mounted upon said lifting apparatus so as to be selectively movable vertically by said lifting apparatus;

(b) rotating means for rotating said frame with respect to said lifting apparatus about a generally forwardly-extending axis of rotation;

(c) first and second selectively openable and closeable opposing clamp arms mounted upon said frame projecting therefrom in a forward direction, each of said clamp arms having a forward end and a rear end respectively;

(d) powered mounting means movably connected said clamp arms to one another and to said frame including a first fluid motor for selectively opening and closing said clamp arms and a second fluid motor for selectively moving said clamp arms in unison generally perpendicular to said axis of rotation between a position of equal extension, wherein the forward ends of said clamp arms are spaced apart from one another by a predetermined distance and extend a substantially equal distance forwardly of said frame, and a position of unequal extension wherein the forward ends of said clamp arms are spaced apart from one another by said predetermined distance and the forward end of one clamp arm extends a greater distance forwardly of said frame than the forward end of the other clamp arm, said powered mounting means including rotation-responsive fluid valve means responsive to the rotational position of said frame and operatively connected to said first and second fluid motors respectively for permitting the selective operation of said first fluid motor while simultaneously preventing the operation of said second fluid motor at a first rotational position of said frame where said clamp arms are substantially one above the other and at a second rotational position of said frame where said clamp arms are substantially side-by-side horizontally and, alternatively, permitting selective operation of said second fluid motor while simultaneously preventing the operation of said first fluid motor at intermediate rotational positions of said frame which are between said first and second rotational positions; and (e) a fluid line interconnecting said first fluid motor with said rotation-responsive fluid valve means for conducting fluid to said first motor tending to open said clamp arms, and pilot-operated valve means connected to said first fluid motor for sensing pressure in said fluid line and preventing the opening of said clamp arms whenever the pressure of fluid in said fluid line is below a predetermined pressure, further including bypass means interconnecting said fluid line with said rotation-responsive fluid valve means for relieving the pressure of fluid in said fluid line, as sensed by said pilot-operated valve means, so as to prevent said pressure from reaching said predetermined pressure whenever said frame is in one of said intermediate rotational positions and for preventing the relief of the pressure of fluid in said fluid line through said bypass means whenever said frame is in either said first or second rotational position.

2. The apparatus of claim 1 wherein said rotation-responsive fluid valve means includes means operatively interconnected with said bypass means for permitting the passage of fluid from said fluid line through said bypass means whenever said frame is in one of said intermediate rotational positions, and preventing the passage of fluid from said fluid line through said bypass means whenever said frame is in either said first or second rotational position.

3. The apparatus of claim 2 wherein said bypass means includes check valve means for preventing passage of fluid toward said fluid line through said bypass means.

* * * * *

UNITED STATES PATENT AND TRADEMARK OFFICE

CERTIFICATE OF CORRECTION

PATENT NO. : 4,177,000

DATED : December 4, 1979

INVENTOR(S) : Harry F. Weinert et al

It is certified that error appears in the above–identified patent and that said Letters Patent are hereby corrected as shown below:

| | | |
|---|---|---|
| Col. 4, | line 53 | After "clamp" add the word --arm. |
| Col. 5, | line 53 | Change "bidirectional" to --bi-directional--. |
| | line 64 | Change "shwon" to --shown--. |
| Col. 8, | line 49 | Change "connected" to --connecting--. |

Signed and Sealed this

*Twenty-fifth* Day of *March 1980*

[SEAL]

*Attest:*

SIDNEY A. DIAMOND

*Attesting Officer*

*Commissioner of Patents and Trademarks*